US009926621B2

(12) United States Patent
Katsumata et al.

(10) Patent No.: US 9,926,621 B2
(45) Date of Patent: Mar. 27, 2018

(54) CARBURIZING DEVICE

(71) Applicants: IHI Corporation, Tokyo (JP); IHI Machinery and Furnace Co., Ltd., Tokyo (JP)

(72) Inventors: Kazuhiko Katsumata, Inuyama (JP); Masatoshi Mitsuzuka, Kakamigahara (JP); Osamu Sakamoto, Kamo-gun (JP); Takahiro Nagata, Kamo-gun (JP)

(73) Assignees: IHI CORPORATION, Tokyo (JP); IHI MACHINERY AND FURNACE CO., LTD., Tokyo (JP)

( * ) Notice: Subject to any disclaimer, the term of this patent is extended or adjusted under 35 U.S.C. 154(b) by 33 days.

(21) Appl. No.: 15/202,770

(22) Filed: Jul. 6, 2016

(65) Prior Publication Data

US 2016/0312352 A1 Oct. 27, 2016

Related U.S. Application Data

(63) Continuation of application No. PCT/JP2015/055399, filed on Feb. 25, 2015.

(30) Foreign Application Priority Data

Apr. 23, 2014 (JP) ..... 2014-089207

(51) Int. Cl.

| | |
|---|---|
| ***C23C 8/20*** | (2006.01) |
| ***F27B 5/04*** | (2006.01) |
| ***F27B 5/06*** | (2006.01) |
| ***F27B 5/14*** | (2006.01) |
| ***F27D 7/04*** | (2006.01) |

(52) U.S. Cl.

CPC ..... *C23C 8/20* (2013.01); *F27B 5/04* (2013.01); *F27B 5/06* (2013.01); *F27B 5/14* (2013.01); *F27D 7/04* (2013.01); *F27B 2005/143* (2013.01); *F27M 2002/12* (2013.01); *F27M 2003/07* (2013.01)

(58) Field of Classification Search

CPC ..... C21D 1/06; F27D 5/00; F27D 5/0006
USPC ..... 266/252
See application file for complete search history.

(56) References Cited

U.S. PATENT DOCUMENTS

| | | | | |
|---|---|---|---|---|
| 2007/0069433 | A1* | 3/2007 | Jones | C21D 1/06 266/252 |
| 2013/0305985 | A1 | 11/2013 | Katsumata | |
| 2016/0312352 | A1* | 10/2016 | Katsumata | C23C 8/20 |

FOREIGN PATENT DOCUMENTS

| | | | |
|---|---|---|---|
| JP | 60-113498 | U | 7/1985 |
| JP | 62-199761 | A | 9/1987 |
| JP | 2-156065 | A | 6/1990 |
| JP | 5-346290 | A | 12/1993 |
| JP | 9-268365 | A | 10/1997 |
| JP | 2005-195238 | A | 7/2005 |

(Continued)

*Primary Examiner* — Scott Kastler
(74) *Attorney, Agent, or Firm* — Rothwell, Figg, Ernst & Manbeck, P.C.

(57) ABSTRACT

A carburizing device is configured to perform a carburizing treatment on a treatment target, and includes a furnace body, an insulating container provided inside the furnace body, a furnace bed provided inside the insulating container and on which the treatment target is mounted, and a heat source provided inside the insulating container, in which at least surfaces of main components of the furnace bed, the heat source and the insulating container are made of a ceramic material.

6 Claims, 4 Drawing Sheets

(56) References Cited

FOREIGN PATENT DOCUMENTS

| | | | |
|---|---|---|---|
| JP | 2006-112770 | A | 4/2006 |
| JP | 2008-69404 | A | 3/2008 |
| JP | 2016-845 | A | 1/2016 |

* cited by examiner

CARBURIZING DEVICE

CROSS-REFERENCE TO RELATED APPLICATIONS

This application is a continuation application based on a PCT Patent Application No. PCT/JP2015/055399, filed on Feb. 25, 2015, whose priority is claimed on Japanese Patent Application No. 2014-089207, filed on Apr. 23, 2014. The contents of both the PCT Application and the Japanese Application are incorporated herein by reference.

TECHNICAL FIELD

Embodiments described herein relate to a carburizing device.

BACKGROUND OF THE INVENTION

A vacuum carburizing furnace, which is a kind of a carburizing device, is disclosed in the following Patent Document 1. In the vacuum carburizing furnace, a thermal insulation material made of a ceramic is provided to surround a workpiece (a treatment target) inside a furnace body. In addition, a furnace bed on which the workpiece serving as a carburizing target object is mounted is provided in a lower part inside the furnace body, and a radiant tube (a heat source) made of a ceramic is provided from an upper part inside the furnace body through left and right sides of the workpiece. In such a vacuum carburizing furnace, when a hydrocarbon-based gas, as a carburizing gas, is supplied into the furnace body and an inside of the furnace body is under a high-temperature environment of 500 to 600° C., carbon obtained by thermal decomposition of the carburizing gas penetrates into a surface of the workpiece (carburization).

Patent Document 1: Japanese Unexamined Patent Application, First Publication No. 2006-112770

The thermal insulation material and the radiant tube inside the furnace body have a relatively simple shape and are made of a ceramic. On the other hand, the furnace bed has a relatively complex shape and is generally made of a metal in consideration of processability. That is, in a carburizing device of the related art, since components inside the furnace body are made of different materials, durability (a durability lifespan) of the components is different for each material, and therefore a maintenance cycle of the components is different for each material.

However, when the maintenance cycle of the components is different for each material in this manner, since a maintenance plan becomes complicated, there may be a problem of usability. Users who operate the carburizing device and perform various workpiece processes strongly demand simple maintenance in order to improve an operation rate of the carburizing device as much as possible.

BRIEF SUMMARY OF THE INVENTION

The present disclosure has been made in view of the aforementioned problems, and an object of the present disclosure is to provide a carburizing device that can be maintained more simply than those of the related art.

According to one aspect of the present disclosure, there is provided a carburizing device configured to perform a carburizing treatment on a treatment target and including: a furnace body; an insulating container provided inside the furnace body; a furnace bed provided inside the insulating container and on which the treatment target is mounted; and a heat source provided inside the insulating container, in which at least surfaces of main components of the furnace bed, the heat source and the insulating container are made of a ceramic material. As the main components, the furnace bed includes: a ceramic receiving member on which the treatment target is directly mounted; and a ceramic leg member that is provided to pass through the insulating container and includes a first end that is connected to the receiving member and a second end that is connected to the furnace body. The leg member is formed to be hollow and an inside of the leg member is filled with a fiber member made of a ceramic material.

According to the present disclosure, since at least surfaces of a heat source, a thermal insulation material and a furnace bed are made of a ceramic material, it is possible to provide a carburizing device that can be maintained more simply than those in the related art.

DETAILED DESCRIPTION OF THE INVENTION

Hereinafter, an embodiment of the present disclosure will be described with reference to the drawings.

Figure 1:
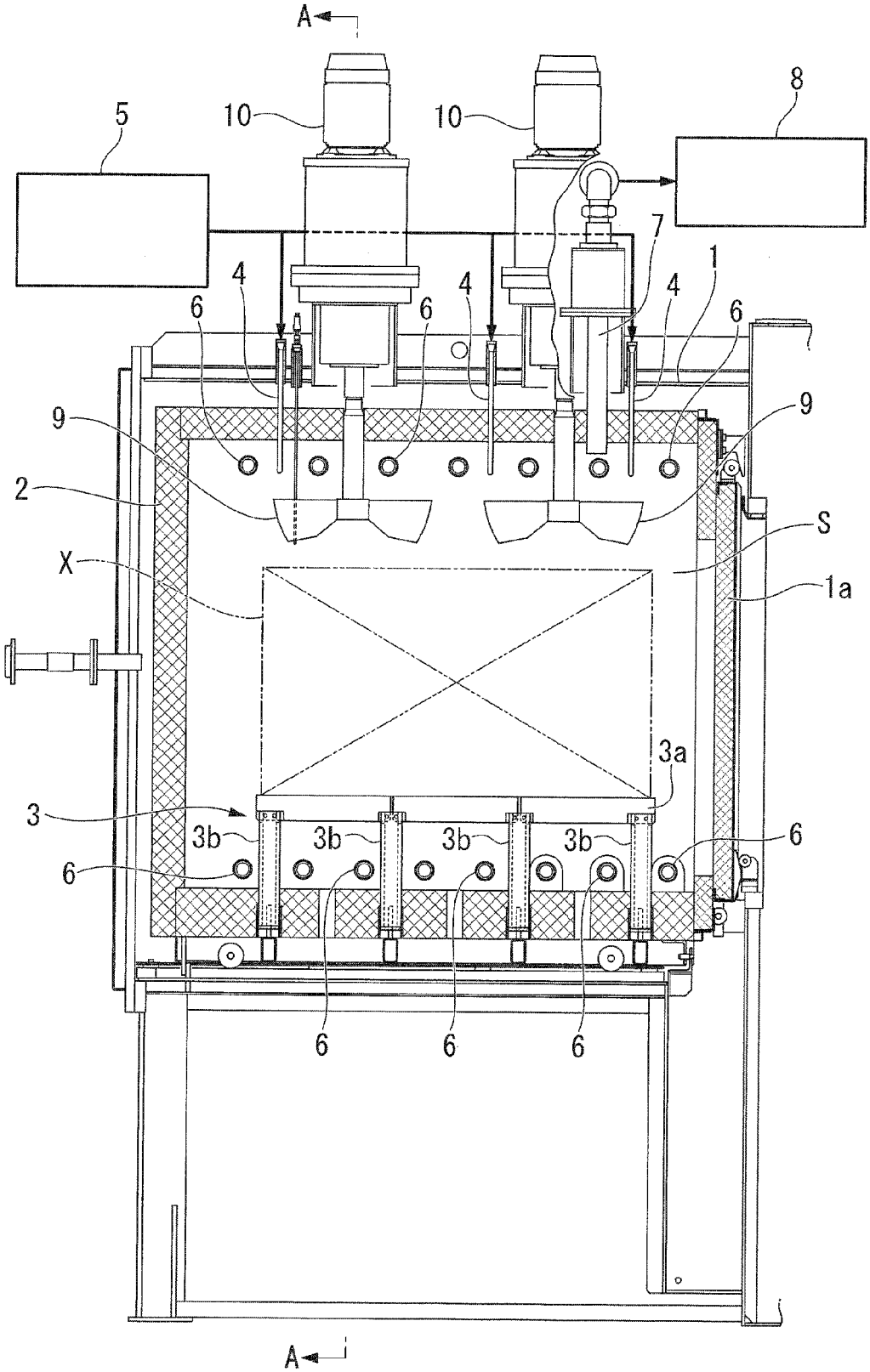
FIG. 1 is a vertical cross-sectional view showing an overall configuration of a carburizing device according to an embodiment of the present disclosure.

As shown in FIG. 1, a carburizing device according to the present embodiment includes a chamber 1 (a furnace body), an insulating container 2, a furnace bed 3, a plurality of carburizing gas inlet pipes 4, a carburizing gas supply source 5, a plurality of heaters 6, an exhaust pipe 7, an exhaust pump 8, a pair of stirring blades 9, a pair of stirring motors 10, a plurality of thermocouples 11 and the like.

Figure 2:
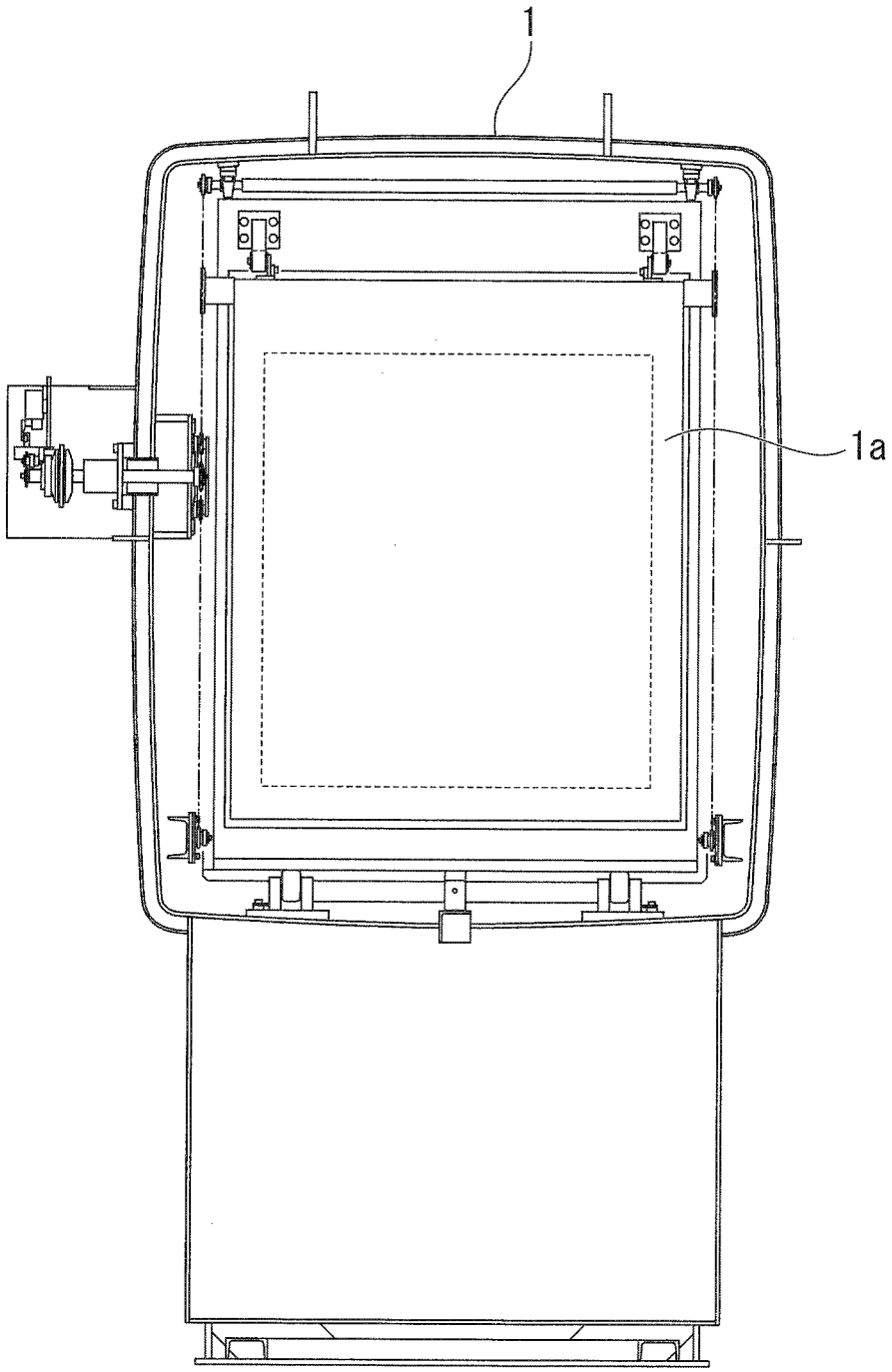
FIG. 2 is a front view of the carburizing device according to the embodiment of the present disclosure.

As shown in FIGS. 1 and 2, the chamber 1 is a main body container having a rectangular parallelepiped shape and has one side surface on which an insulated door 1*a* is provided. The insulated door 1*a* is an opening and closing door through which a treatment target X is loaded into and unloaded from the chamber 1. The insulated door 1*a* is vertically erected and slides in a perpendicular direction (a vertical direction) so that an inside of the chamber 1 is opened or closed to the outside. In addition, since a thermal insulation material is provided inside the insulated door 1*a*, a thermal insulation characteristic is also provided.

Figure 3:
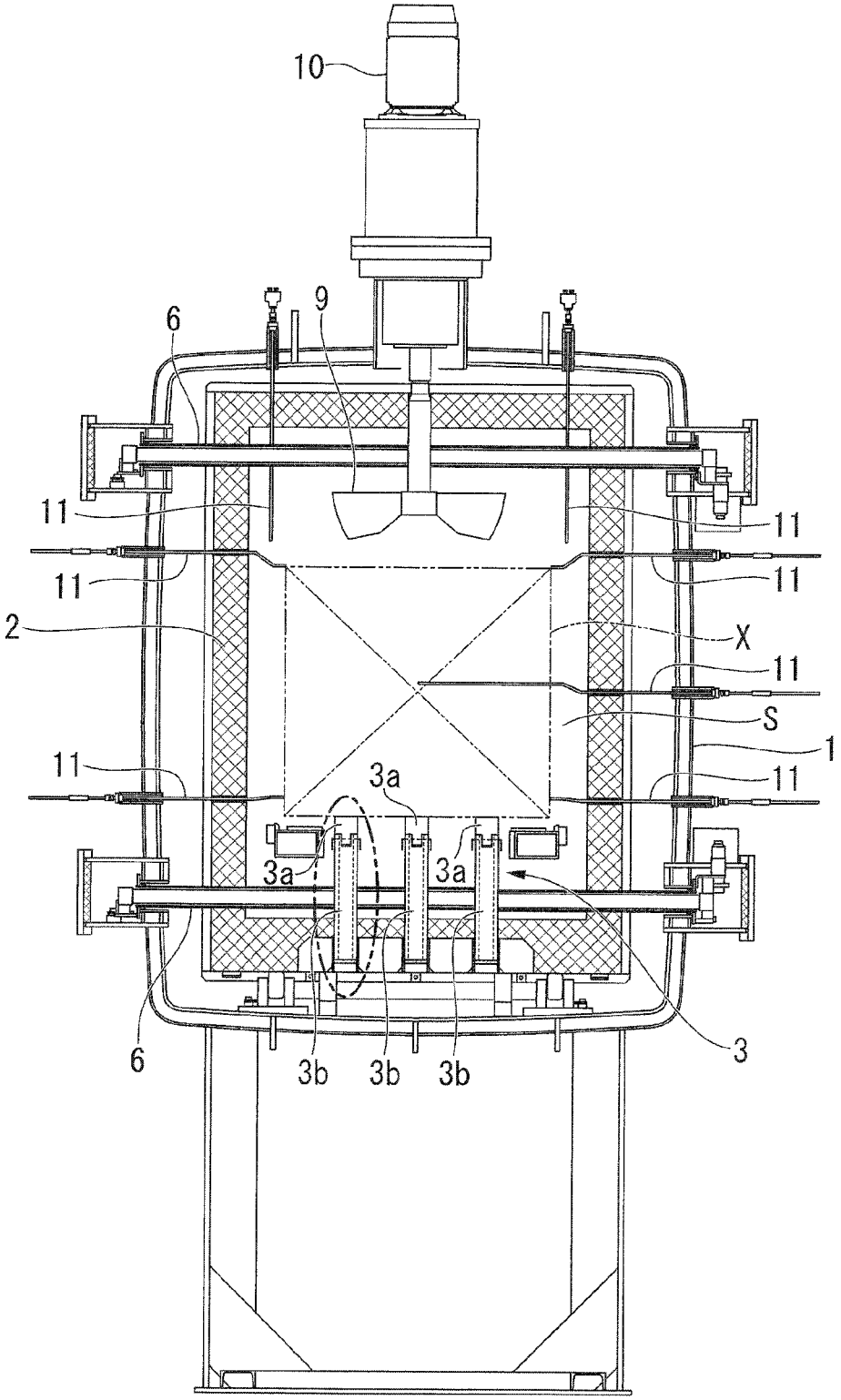
FIG. 3 is a cross-sectional view taken along the line A-A in FIG. 1.

As shown in FIGS. 1 and 3, the insulating container 2 is a container that is provided inside the chamber 1, has a rectangular parallelepiped shape, and is made of a thermal insulation material (a ceramic material) having a predetermined thermal insulation characteristic. An internal space of the insulating container 2 includes a carburizing chamber S in which the treatment target X is accommodated and subjected to a carburizing treatment. The treatment target X (a carburizing target object) is loaded into the carburizing chamber S through the insulated door 1*a*. Note that, in the present embodiment, a horizontal direction parallel to the insulated door 1*a* is defined as a width direction of the chamber 1 (the carburizing chamber S), and a horizontal direction perpendicular to the insulated door 1*a* is defined as a depth direction of the chamber 1 (the carburizing chamber S).

The furnace bed 3 is the most distinctive component of the carburizing device according to the present embodiment and is provided in an inner lower part of the insulating container 2 as shown in FIGS. 1 and 3. The furnace bed 3 is a mounting table on which the treatment target X loaded from the outside through the insulated door 1*a* is mounted, and main components of the furnace bed 3 are made of a ceramic material such as alumina. That is, the main components of the furnace bed 3 are ceramic members.

Figure 4:
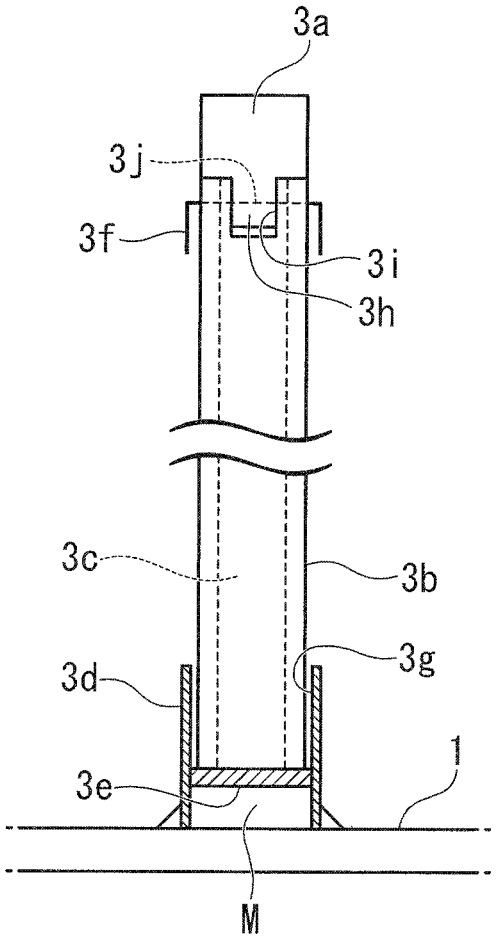
FIG. 4 is a partially enlarged view of a furnace bed in the carburizing device according to the embodiment of the present disclosure.

Details will be further described with reference to FIG. 4 in addition to FIG. 1 and FIG. 3. The furnace bed 3 includes a receiving member 3*a*, a leg member 3*b*, a fiber member 3*c*, a support member 3*d*, a pedestal member 3*e* and a locking pin 3*f*. Note that a plurality of such members are provided as shown in FIGS. 1 and 3. In addition, the receiving member 3*a* and the leg member 3*b* are the main components of the furnace bed 3.

The receiving member 3*a* is a square bar shaped member that abuts the treatment target X and is made of a ceramic material such as alumina. The receiving member 3*a* extends in the depth direction (the horizontal direction) of the carburizing chamber S, and is provided in three columns at predetermined intervals in the width direction (the horizontal direction) of the carburizing chamber S. In addition, as shown in FIG. 1, three of the receiving members 3*a* are connected in the depth direction. That is, in the furnace bed 3, three of the receiving members 3*a* each are arranged in the depth direction and the width direction (a total of 9).

The leg member 3*b* is a square bar shaped member in which a longitudinal direction is defined as the perpendicular direction (the vertical direction), and is made of a ceramic material such as alumina. The leg member 3*b* passes through the insulating container 2, and includes an upper end that abuts the receiving member 3*a* and a lower end that abuts the pedestal member 3*e*. The four leg members 3*b* are provided in columns of the receiving member 3*a* to abut ends of the receiving member 3*a*. In addition, the leg member 3*b* is a hollow square bar, and an inside of the leg member 3*b* is filled with the fiber member 3*c*. The fiber member 3*c* is formed by bundling fibers made of a ceramic material such as glass.

The support member 3*d* is a metal member that is welded and fixed to an inner surface of the chamber 1 and in which a rectangular opening 3*g* that is opened upward is formed. The rectangular opening 3*g* is formed in a shape in which a lower end of the leg member 3*b* is fitted to be freely inserted and removed. That is, in the furnace bed 3, the receiving member 3*a* and the leg member 3*b*, which are the main components, are detachable from the chamber 1.

The pedestal member 3*e* is a rectangular plate member (a metal member) that is welded and fixed to the support member 3*d* at a position in the rectangular opening 3*g* separated by a predetermined dimension from the inner surface of the chamber 1. That is, in the furnace bed 3, the inner surface of the chamber 1, the support member 3*d* and the pedestal member 3*e* form an enclosed space M. Accordingly, the leg member 3*b* faces the inner surface of the chamber 1 with the enclosed space M therebetween.

The locking pin 3*f* is a thin line-shaped member that engages the receiving member 3*a* and the leg member 3*b* with each other. As shown in FIG. 4, a rectangular convex portion 3*h* is formed at a lower center of the receiving member 3*a*, and a rectangular concave portion 3*i* fitted to the rectangular convex portion 3*h* is formed on an upper end of the leg member 3*b*. In addition, the through-hole 3*j* is formed through the rectangular convex portion 3*h* and the rectangular concave portion 3*i* at a position at which the rectangular convex portion 3*h* and the rectangular concave portion 3*i* correspond to each other. When the locking pin 3*f* is inserted into the through-hole 3*j*, the receiving member 3*a* is engaged with the leg member 3*b*.

The size of the through-hole 3*j* is slightly greater than the thickness of the locking pin 3*f*.

Accordingly, the receiving member 3*a* and the leg member 3*b* are not mechanically firmly engaged, but are engaged with a certain degree of play, that is, are engaged with each other in a movable manner. Note that the locking pin 3*f* is made of a metal such as molybdenum (Mo) whose mechanical characteristics do not relatively decrease even in a high-temperature environment.

The plurality of carburizing gas inlet pipes 4 are pipe lines for introducing a carburizing gas such as acetylene into the carburizing chamber S, and include distal ends that are opened into the carburizing chamber S and rear ends that communicate with the carburizing gas supply source 5.

The carburizing gas supply source 5 discharges the carburizing gas having a predetermined flow rate to the carburizing gas inlet pipes 4. That is, the carburizing gas whose flow rate is set is supplied by the carburizing gas supply source 5 into the carburizing chamber S.

As shown in FIG. 3, the plurality of heaters 6 are rod-shaped heat sources that extend in the horizontal direction, and are provided in an inner upper part and inner lower part of the insulating container 2 at predetermined intervals. The plurality of heaters 6 are formed such that a rod-shaped heat-generating element is accommodated inside a straight pipe made of a ceramic, and heat the treatment target X inside the carburizing chamber S to a predetermined temperature (a heating temperature). Note that heating conditions such as the heating temperature and a heating time are appropriately set based on a purpose of the carburizing treatment or a material of the treatment target X.

The exhaust pipe 7 is a pipe line that includes a first end that is opened into the carburizing chamber S and a second end that is connected to a suction port of the exhaust pump 8. The exhaust pump 8 exhausts a gas (for example, a carburizing gas, and a pyrolysis gas generated when the carburizing gas is thermally decomposed) inside the carburizing chamber S to the outside of the carburizing chamber S through the exhaust pipe 7. An exhaust amount of the exhaust pump 8 is appropriately set according to a purpose of the carburizing treatment or a material of the treatment target X.

The pair of stirring blades 9 are provided in an inner upper part (a position closer to the treatment target X than the heater 6) of the insulating container 2 such that a rotation axis direction matches the perpendicular direction (the vertical direction). The stirring blade 9 is driven by the stirring motor 10 and therefore stirs a gas inside the carburizing chamber S. The pair of stirring motors 10 are rotary driving sources that are provided in an upper part of the chamber 1 such that an output axis matches the perpendicular direction (the vertical direction). The output axis of the stirring motor 10 is axially coupled to the rotation axis of the stirring blade 9 positioned inside the chamber 1 such that air tightness (sealability) of the chamber 1 is not impaired.

As shown in FIG. 3, the plurality of thermocouples 11 are discretely disposed to surround the treatment target X inside the carburizing chamber S. The thermocouple 11 detects an atmosphere temperature inside the carburizing chamber S, which is similar to a surface temperature of the treatment target X, and outputs the detection result to a control panel.

Although not shown in FIGS. 1 to 4, the carburizing device according to the present embodiment includes a dedicated control panel (a controller). The control panel includes a manipulation unit for a user to set and input various conditions in the carburizing treatment, and a control unit configured to control driving units such as the carburizing gas supply source 5, the heater 6 and the exhaust pump 8 based on a control program that is stored in advance therein, and perform the carburizing treatment based on setting information about the treatment target X and the temperature detected by the thermocouple 11.

Next, operations (a carburizing treatment method) of the carburizing device having such a configuration will be described in detail. Note that the operations of the carburizing device are independently performed by the control panel based on the setting information and the temperature detected by the thermocouple 11.

The treatment target X is mounted on the furnace bed 3 by an external conveying device while the insulated door 1*a* is opened. In this case, the treatment target X is accommodated inside an accommodating container such as a basket or a tray and is mounted on the furnace bed 3. Then, when the insulated door 1*a* is closed, an inside of the carburizing chamber S becomes an enclosed space.

When the exhaust pump 8 is operated to exhaust air inside the carburizing chamber S to the outside and an atmosphere (an ambient atmosphere of the treatment target X) inside the carburizing chamber S is depressurized to a predetermined vacuum state (a pressure state), the heater 6 is operated and the surface temperature of the treatment target X increases to a predetermined temperature (a carburizing temperature). Note that, when the treatment target X is heated, an operation of the exhaust pump 8 is temporarily suspended. Accordingly, when the heater 6 is controlled based on the detection result of the thermocouple 11, the surface temperature of the treatment target X gradually increases over a certain period of time under the pressure environment at a constant temperature and reaches the carburizing temperature.

While the surface temperature of the treatment target X is stable at the carburizing temperature, when the carburizing gas supply source 5 is operated, the carburizing gas having a predetermined flow rate is continuously introduced into the carburizing chamber S through the carburizing gas inlet pipes 4. On the other hand, the operation of the exhaust pump 8 is resumed in response to the operation of the carburizing gas supply source 5, and the gas inside the carburizing chamber S is exhausted to the outside through the exhaust pipe 7.

When the carburizing gas supply source 5 and the exhaust pump 8 are simultaneously operated, a degree of vacuum (a pressure) inside the carburizing chamber S remains at a predetermined pressure (a carburizing pressure). That is, when a balance between an introduction amount of the carburizing gas that is continuously introduced into the carburizing chamber S from the carburizing gas inlet pipes 4 and a discharge amount of a gas that is exhausted from the inside of the carburizing chamber S to the outside through the exhaust pipe 7 is maintained, the pressure inside the carburizing chamber S remains at a predetermined carburizing pressure.

When a state in which the carburizing pressure is maintained continues for a predetermined time (a carburizing time), carbon atoms (C) generated when the carburizing gas is thermally decomposed gradually penetrate into the treatment target X from the surface of the treatment target X. As a result, a carburizing layer of a predetermined depth (a carburized depth) is formed in the vicinity of the surface of the treatment target X. That is, the carburized depth of the treatment target X is mainly controlled by the carburizing time.

Here, a hydrocarbon such as acetylene ($C_2H_2$) or methane ($CH_4$) is generally used as the carburizing gas. When the carburizing gas is thermally decomposed, carbon atoms (C) and hydrogen gas ($H_2$) are generated. The carbon atoms (C) contribute to carburizing of the treatment target X, and the hydrogen gas ($H_2$) is exhausted from the exhaust pipe 7 to the outside of the carburizing chamber S as an excess gas. However, the carbon atoms (C) and the hydrogen gas ($H_2$) exhibit strong activity at the carburizing temperature and degrade members inside the carburizing chamber S. In addition, the members inside the carburizing chamber S are degraded when the members are exposed to the carburizing temperature of 500° C. or more.

A member that is particularly likely to be degraded is the furnace bed 3 positioned in the vicinity of the treatment target X, and specifically the receiving member 3*a* and the leg member 3*b*, which are the main components. These main components of the furnace bed 3 are replacement components that are replaced for maintenance. In a carburizing device of the related art, since main components of a furnace bed are made of a metal material (for example, heat-resistant steel), degradation of replacement components progresses at a different degree from other replacement components, for example, an insulating container made of a ceramic material.

On the other hand, in the carburizing device according to the present embodiment, since the main components (the receiving member 3*a* and the leg member 3*b*) of the furnace bed 3 are made of a ceramic material in the same manner as other replacement components, for example, the insulating container 2, a replacement time of the main components in the furnace bed 3 and a replacement time of other replacement components can be substantially the same. Therefore, according to the carburizing device in the present embodiment, it is possible to simplify the maintenance more than in the related art.

In addition, in the furnace bed 3 according to the present embodiment, since the leg member 3*b* is detachable from the chamber 1, workability when the leg member 3*b* is replaced is good. In addition, when the locking pin 3*f* is removed, the receiving member 3*a* and the leg member 3*b* can be easily separated, and therefore the receiving member 3*a* and the leg member 3*b* have good maintainability.

In addition, in the furnace bed 3 according to the present embodiment, the lower end of the leg member 3*b* is not directly in contact with the inner surface of the chamber 1, that is, the lower end of the leg member 3*b* faces the inner surface of the chamber 1 with the enclosed space M, which serves as an insulated space, therebetween. Accordingly, it is possible to suppress heat inside the carburizing chamber S from being released to the outside through the leg member 3*b* and the chamber 1.

In addition, compared to when the leg member 3*b* is formed to be solid, since the leg member 3*b* is formed to be hollow and the inside of the leg member 3*b* is filled with the fiber member 3*c* made of a ceramic material, it is possible to suppress heat conduction of the leg member 3*b*. Accordingly, it is possible to suppress the heat inside the carburizing chamber S from being released to the outside through the leg member 3*b* and the chamber 1.

The present disclosure is not limited to the embodiment. For example, the following modifications can be considered.

(1) While the main components (the receiving member 3*a* and the leg member 3*b*) of the furnace bed 3 are made of a ceramic material as a whole in the above embodiment, the present disclosure is not limited thereto. At least surfaces of the main components of the furnace bed 3 may be made of a ceramic material. For example, when a surface of a base material made of a metal material is subjected to ceramic coating, only the surfaces of the main components of the furnace bed 3 is covered with the ceramic material.

(2) While a material of the pair of stirring blades 9 that are inside the insulating container 2 and positioned above the treatment target X is not particularly limited in the above embodiment, a ceramic material is preferably used as the material. Since the pair of stirring blades 9 are also placed under substantially the same environment as the main components of the furnace bed 3, when the pair of stirring blades 9 are made of a ceramic material, the pair of stirring blades 9 have the same replacement time as the main components of the furnace bed 3. The pair of stirring blades 9 and the pair of stirring motors 10 are not necessarily required, but may be omitted.

(3) While the receiving members 3*a* are provided in three columns in the width direction of the carburizing chamber S in the above embodiment, the present disclosure is not limited thereto. The receiving members 3*a* may be provided in two columns at a predetermined interval. In addition, while three of the receiving members 3*a* are provided in the depth direction of the carburizing chamber S, one elongated receiving member 3*a* may be alternatively provided.

(4) While carburizing conditions are not specifically limited in the above embodiment, the carburizing conditions may be changed according to a purpose of carburizing and a material of the treatment target X. However, when acetylene is used as the carburizing gas, preferably, the carburizing pressure is set to 1 kPa or less, and the carburizing temperature is set to about 1000° C.

According to the present disclosure, it is possible to provide a carburizing device that can be maintained more simply than those in the related art.

What is claimed is:

1. A carburizing device configured to perform a carburizing treatment on a treatment target, the carburizing device comprising:

a furnace body;

an insulating container provided inside the furnace body;

a furnace bed provided inside the insulating container and on which the treatment target is mounted; and a heat source provided inside the insulating container, wherein at least surfaces of main components of the furnace bed, the heat source and the insulating container are made of a ceramic material, wherein, as the main components, the furnace bed includes:

a ceramic receiving member on which the treatment target is directly mounted; and a ceramic leg member that is provided to pass through the insulating container and includes a first end that is connected to the receiving member and a second end that is connected to the furnace body, and wherein the leg member is formed to be hollow and an inside of the leg member is filled with a fiber member made of a ceramic material.

2. The carburizing device according to claim 1, wherein the leg member is connected to be detachable from the furnace body.

3. The carburizing device according to claim 1, wherein the leg member faces the furnace body with an enclosed space therebetween.

4. The carburizing device according to claim 2, wherein the leg member faces the furnace body with an enclosed space therebetween.

5. The carburizing device according to claim 1, wherein the receiving member is connected to be detachable from the leg member.

6. The carburizing device according to claim 5, wherein the receiving member and the leg member are connected to each other when a locking pin is inserted into both of a through-hole that is provided in the receiving member and a through-hole that is provided in the leg member.

* * * * *